US012070646B2

(12) United States Patent
Paganelli et al.

(10) Patent No.: US 12,070,646 B2
(45) Date of Patent: Aug. 27, 2024

(54) SYSTEM FOR MONITORING A GYM APPARATUS AND FUNCTIONING METHOD OF THE SYSTEM

(71) Applicant: Technogym S.p.A, Cesena (IT)

(72) Inventors: Paolo Paganelli, Cesena (IT); Enrico Vannoni, Cesena (IT)

(73) Assignee: Technogym S.p.A, Cesena FC (IT)

( * ) Notice: Subject to any disclaimer, the term of this patent is extended or adjusted under 35 U.S.C. 154(b) by 190 days.

(21) Appl. No.: 17/945,142

(22) Filed: Sep. 15, 2022

(65) Prior Publication Data

US 2023/0080174 A1 Mar. 16, 2023

(30) Foreign Application Priority Data

Sep. 15, 2021 (IT) ..... 102021000023756

(51) Int. Cl.

| | |
|---|---|
| ***A63B 21/075*** | (2006.01) |
| ***A63B 21/00*** | (2006.01) |
| | ***A63B 21/072*** |
| (2006.01) | ***A63B 24/00*** |
| (2006.01) | |

(52) U.S. Cl.

CPC ..... *A63B 21/075* (2013.01); *A63B 21/0726* (2013.01); *A63B 21/4035* (2015.10); (Continued)

(58) Field of Classification Search

CPC ..... A63B 21/0726; A63B 21/075; A63B 21/4035; A63B 24/0087; A63B 71/0036; (Continued)

(56) References Cited

U.S. PATENT DOCUMENTS 9,776,032 B2 * 10/2017 Moran ..... A63B 24/0087
9,895,571 B2 * 2/2018 Wang ..... A63B 21/0724
(Continued)

OTHER PUBLICATIONS

Rapporto di Ricerca e l'Opinione Scritta [Search Report and the Written Opinion] Dated Jun. 22, 2022 From the Ministero Dello Sviluppo Economico, Direzione Generale Sviluppo Produttivo e Competitivita, Ufficio Italiano Brevetti e Marchi Re. Application No. IT 202100023756. (9 Pages).

*Primary Examiner* — Joshua Lee

(57) ABSTRACT

The present invention relates to a system (S) for monitoring the weight adjustment of a dumbbell, which can be used by a user to perform a gymnastic exercise, comprising: a dumbbell (2), provided with a handle (21), having an axial development along an axis (R), able to rotate around said axis (R), clockwise and counterclockwise, and provided with a first end (211) and a second end (212), a first plurality of weights (P1), wherein each weight can be individually coupled to said first end (211), when said handle (21) rotates in one direction, and decoupled from said first end (211), when said handle (21) rotates in the opposite direction, a second plurality of weights (P2), wherein each weight can be individually coupled to said second end (212), when said handle (21) rotates in one direction, and decoupled from said second end (212), when said handle (21) rotates in the opposite direction, wherein said system (S) is characterised in that it comprises an element provided with a plurality of reflective portions ($\mathbf{321}_{a,b,\ldots,n}$), in that it comprises at least one detection device (5) able to detect data coming from at least one reflective portion ($\mathbf{321}_k$) and able to send said data, and in that it comprises a logic control unit (U) able to receive said data sent by said at least one detection device (5) and to associate to said data a weight of said first (P1) and second (P2) plurality of weights. The present invention also relates to the method for operating such system.

10 Claims, 5 Drawing Sheets

(52) U.S. Cl.
CPC ..... *A63B 24/0087* (2013.01); *A63B 2220/52* (2013.01); *A63B 2220/833* (2013.01); *A63B 2225/20* (2013.01)

(58) Field of Classification Search
CPC ..... A63B 71/0622; A63B 2071/0694; A63B 2220/52; A63B 2220/805; A63B 2220/833; A63B 2225/20; A63B 2225/50
See application file for complete search history.

(56) References Cited

U.S. PATENT DOCUMENTS 10,022,583 B2 * 7/2018 Wang ..... A63B 21/0726
10,463,906 B2 * 11/2019 Owusu ..... A63B 21/072
10,518,123 B2 * 12/2019 Moran ..... A63B 21/0726
10,617,905 B2 * 4/2020 Moran ..... A63B 71/0619
10,786,700 B2 * 9/2020 Owusu ..... A63B 21/075
10,843,028 B2 * 11/2020 Nalley ..... A63B 21/075
10,933,272 B2 * 3/2021 Polinsky ..... A63B 21/0626
11,007,397 B2 * 5/2021 Liu ..... A63B 21/4035
11,154,744 B2 * 10/2021 Henniger ..... A63B 21/0728
11,260,270 B1 * 3/2022 Owusu ..... A63B 71/0036
11,285,354 B1 * 3/2022 Tseng ..... A63B 21/0726
11,452,902 B2 * 9/2022 Moran ..... A63B 21/075
11,491,361 B2 * 11/2022 Flick ..... A63B 21/075
2015/0367163 A1 * 12/2015 Moran ..... A63B 71/0036 482/108
2016/0184623 A1 6/2016 Moran et al.
2017/0001061 A1 1/2017 Marjama et al.
2018/0036578 A1 * 2/2018 Moran ..... A63B 21/0728

* cited by examiner

SYSTEM FOR MONITORING A GYM APPARATUS AND FUNCTIONING METHOD OF THE SYSTEM

RELATED APPLICATION

This application claims the benefit of priority of Italy Patent Application No. 102021000023756 filed on Sep. 15, 2021, the contents of which are incorporated by reference as if fully set forth herein in their entirety.

FIELD AND BACKGROUND OF THE INVENTION

The present invention relates to a system for monitoring an exerciser, in particular for monitoring the weight adjustment of a dumbbell for performing a gymnastic exercise.

The present invention also relates to the method for operating such system for monitoring the weight adjustment of a dumbbell.

More specifically, the invention relates to a system, designed and made in particular for monitoring the adjustment of the amount of weight loaded on a dumbbell for performing a strength gymnastic exercise, but which can be used for any gymnastic exercise involving the use of a dumbbell.

In the following, the description will be addressed to a dumbbell comprising a system for monitoring the adjustment of the weight selected from a plurality of weights that can be selected on the basis of the strength gymnastic exercise to be performed, but it is very clear that the same should not be considered limited to this specific use.

As is well known, strength training systems are currently being used to develop the strength and improve the muscular endurance of a user.

The activities typically associated to the strength training involve the use of a resistance, often in the form of weights, to increase muscle recruitment and promote the increase of the maximal strength.

Workouts may therefore require the use of free weights, such as barbells and dumbbells, wherein a user controls the movement or position of these weights over a period of time or for a number of sets and repetitions.

While performing exercises with free weights, a user may undertake movements unconstrained by support equipment and therefore a user often performs such movements in an environment without equipment, such as a domestic environment.

Usually, both dumbbells and barbells include a bar or handle at the ends of which one or more weights, usually circular in shape, are fixed on the basis of the resistance required for performing the exercise.

Placing weights on the bar often turns out to be an operation that requires the user to interrupt the exercise for a prolonged period necessary to load or unload the weights.

Therefore, compact weight loading systems, mainly used for dumbbells, have become widespread, wherein by means of an actuation device, it is possible to select the weight from a plurality of weights already arranged near the bar, thus reducing the loading and unloading time by the user.

In these types of dumbbells, the user must know the weight loaded on the dumbbell, in order to precisely perform the exercise.

Weight detection devices are currently known which measure the weight loaded on the dumbbell during weight selection.

However, these devices often prove to be unreliable in detecting the exact weight.

In the light of the above, it is therefore an aim of the present invention to provide a system for monitoring the weight adjustment of a dumbbell which is reliable and easy to make.

Another aim of the invention is to provide a system allowing to acquire and store the weight measurement that was performed.

A further aim is to provide a reliable method for operating the detection system.

SUMMARY OF THE INVENTION

Therefore, a specific object of the present invention is a system for monitoring the weight adjustment of a dumbbell, which can be used by a user to perform a gymnastic exercise, comprising: a dumbbell, provided with a handle, having an axial development along an axis, able to rotate around said axis, clockwise and counterclockwise, and provided with a first end and a second end, a first plurality of weights, wherein each weight can be individually coupled to said first end, when said handle rotates in one direction, and decoupled from said first end, when said handle rotates in the opposite direction, a second plurality of weights, wherein each weight can be individually coupled to said second end, when said handle rotates in one direction, and decoupled from said second end, when said handle rotates in the opposite direction, wherein said system comprises an element provided with a plurality of reflective portions, comprises at least one detection device able to detect data coming from at least one reflective portion and able to send said data, and comprises a logic control unit able to receive said data sent by said at least one detection device and to associate to said data a weight of said first and second plurality of weights.

Always according to the invention, said detection device comprises at least one sensor, able to emit electromagnetic waves and receive electromagnetic waves reflected from at least one portion of said plurality of reflective portions.

Preferably according to the invention, said system comprises a numbered ring comprising a plurality of numbers associated to said first and second plurality of weights, and said plurality of reflective portions is arranged on said numbered ring, so that each number is arranged in correspondence with a portion of said plurality of reflective portions.

Still according to the invention, said at least one sensor is arranged in said first end and/or in said second end of said handle.

Further according to the invention, said plurality of reflective portions is arranged on said handle.

Always according to the invention, said system comprises a support frame, to rest said dumbbell, and said at least one detection device is arranged on said support frame.

Preferably according to the invention, said at least one sensor is able to emit electromagnetic waves directed towards said plurality of reflective portions, detect the electromagnetic waves reflected by the portion of said plurality of reflective portions aligned with it, and send corresponding data.

Still according to the invention, said system includes a communication module, able to receive said data and/or said processed data and send them to remote devices or cloud units.

A specific object of the present invention is also a method for operating a system for monitoring the weight adjustment of a dumbbell, comprising the following steps: providing a handle able to rotate in one direction to select one or more weights of said first and second plurality of weights, or in an opposite direction to release one or more weights from said dumbbell; emitting electromagnetic waves directed towards the portion of said plurality of reflective portions aligned with said detection device; detecting the electromagnetic waves reflected by the portion of said plurality of reflective portions aligned with it in the form of data; sending said data to a logic control unit; processing said data obtained in said step to associate a value of one or more selected or released weights; sending said calculated value to remote devices and/or cloud units.

BRIEF DESCRIPTION OF THE SEVERAL VIEWS OF THE DRAWINGS

The present invention will now be described for illustrative but not limitative purposes, according to its preferred embodiments, with particular reference to the figures of the attached drawings, where.

DESCRIPTION OF SPECIFIC EMBODIMENTS OF THE INVENTION

In the various figures similar parts will be indicated with the same numerical references.

Figure 1:
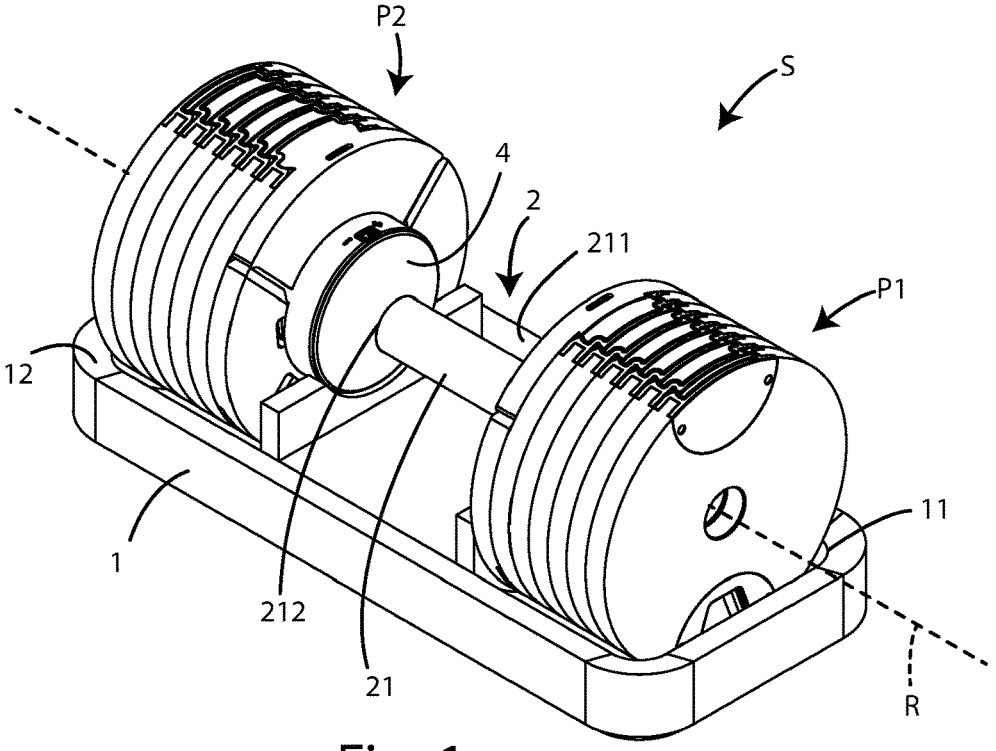
FIG. 1 shows a perspective view of the system for monitoring the weight adjustment of a dumbbell, object of the present invention.

Referring to FIG. 1, the system S for monitoring the weight adjustment of a dumbbell, object of the present invention, essentially comprises a support frame 1, a dumbbell 2 housed on said support frame 1, a first plurality of weights P1 and a second plurality of weights P2, which can be coupled to said dumbbell 2.

Said support frame 1 comprises a first housing 11 and a second housing 12.

Said dumbbell 2 comprises a handle 21 which develops axially along an axis R, around which said handle 21 is able to rotate clockwise and counterclockwise.

Said handle 21 is a hollow cylindrical elongated body which extends along said axis R.

Figure 3:
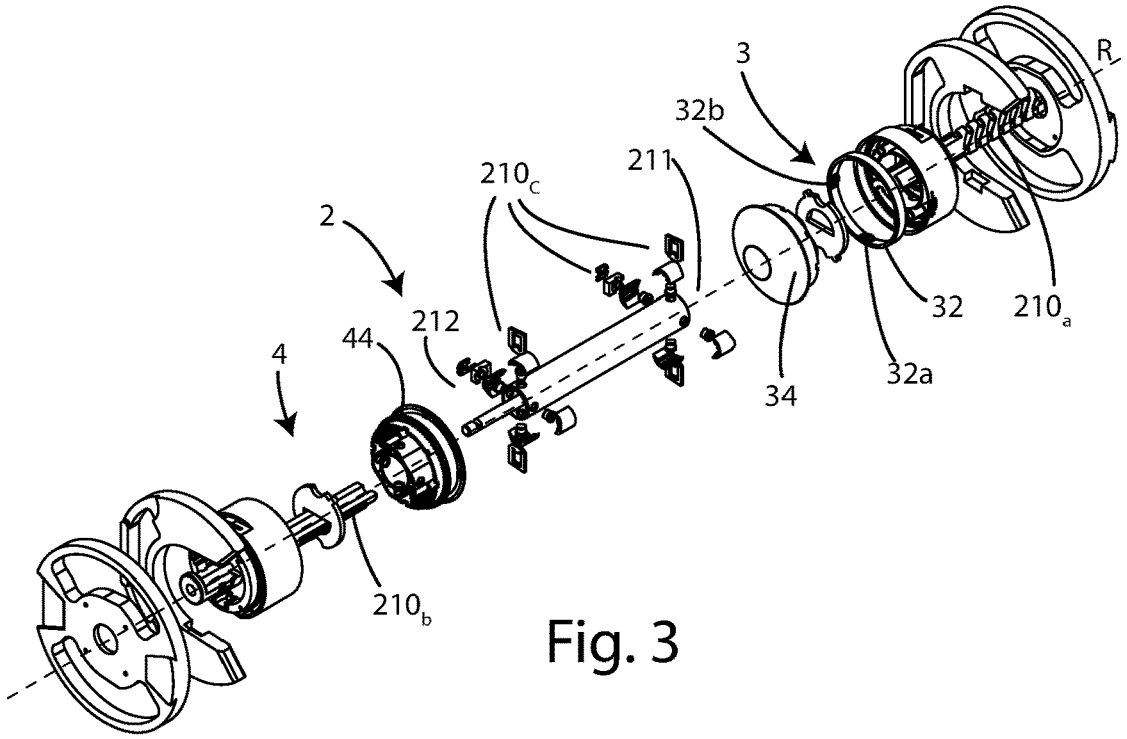
FIG. 3 shows a further exploded view of the system shown in FIG. 1.

Referring to FIG. 3, inside the handle 21 there are a first selector element 210*a* and a second selector element 210*b*, on whose surfaces helical grooves are formed.

The rotation of the handle 21 causes a progressive translation along the axis R of said first 210*a* and second 210*b* selector element. This allows to select at least one weight both from said first P1 and from said second P2 plurality of weights.

Said first 210*a* and second 210*b* selector element are movably coupled to said first handle 21 by means of a plurality of pivots 210*c*, integral with said first handle 21.

Said first 210*a* and second 210*b* selector element are able to pass from a closing position, wherein they are entirely contained inside said first handle 21 and facing each other, towards a plurality of opening positions wherein they move away from each other by translating along said axis R, moving in opposite directions of said axis R.

The rotation of the handle 21 and of the plurality of pivots 210*c* integral with it, causes the progressive axial displacement of said first 210*a* and second 210*b* selector element.

The plurality of pivots 210*c* engages into the helical grooves of said first 210*a* and second 210*b* selector element, causing their axial movement along the axis R.

Said handle 21 has a first end 211 and a second end 212.

Said first plurality of weights P1 is associated to the first end 211, while said second plurality of weights P2 is associated to the second end 212.

Each weight of said first P1 and second P2 plurality of weights is shaped so as to ensure a shape coupling with the contiguous weights.

When said dumbbell 2 rests on said support frame 1, said first plurality of weights P1 is arranged in said first housing 11, while said second plurality of weights P2 is arranged in said second housing 12.

On each of said first 211 and second 212 ends, selection members are arranged to fix each weight to said handle 21.

In particular, a first selection member 3 is fixed on said first end 211, while a second selection member 4 is fixed on said second end 212.

For the sake of simplicity, herein below it is given the description regarding the structure of said first selection member 3, since the structure of said second selection member 4 is unchanged compared to said first selection member 3.

Referring to FIGS. 2-8, said first selection member 3 comprises a hollow element 31, a numbered ring 32, a coupling means 33 and a cover 34 for closing said first locking means 3.

When said hollow element 31 rests on said support frame 1, it is integral with it and therefore is stationary.

Said coupling means 33 internally comprises a first toothed circular portion, not shown in the figure, and an opening 331.

Said cover 34 is integral with said handle 21 and is therefore able to rotate with it.

Said cover 34 internally comprises a second toothed circular portion 341.

Figure 2:
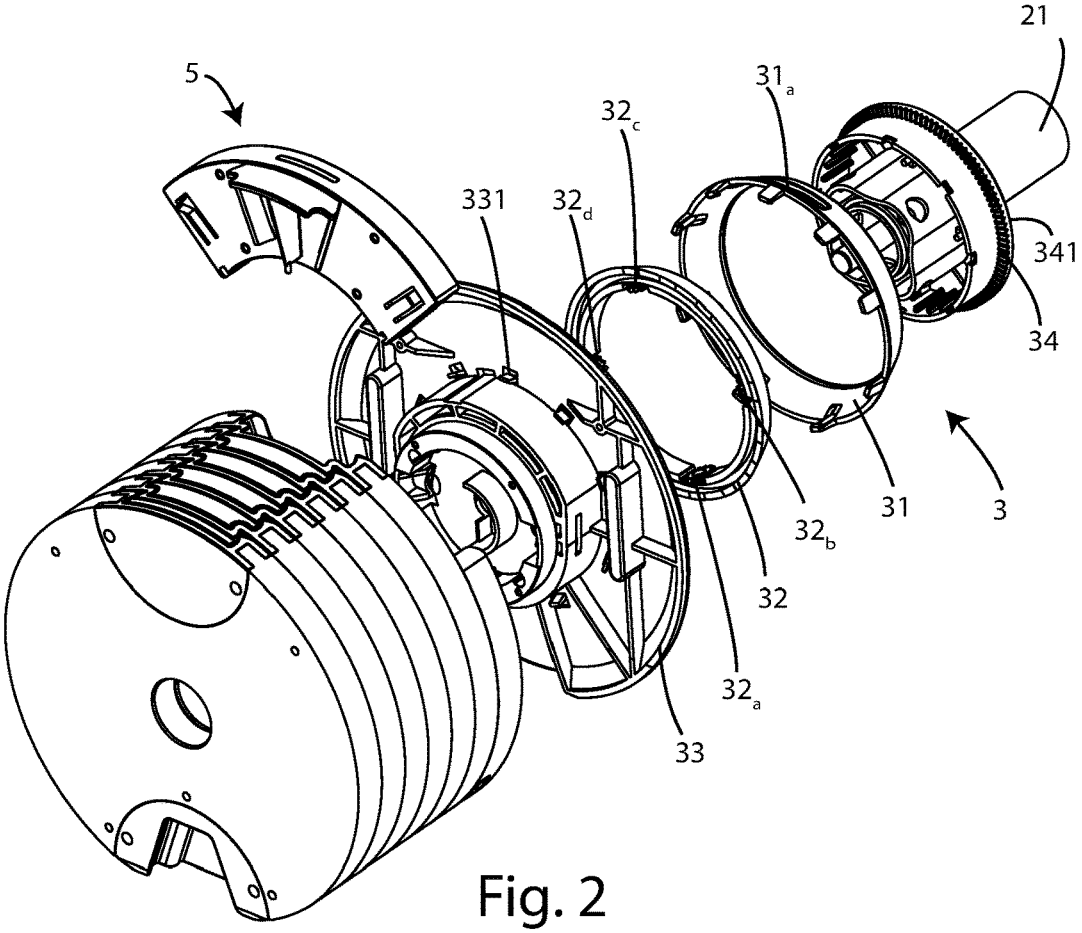
FIG. 2 shows an exploded view of the system shown in FIG. 1.

As shown in FIG. 2, said numbered ring 32 comprises one or more small wheels $\mathbf{32}_n$, in particular four small wheels $\mathbf{32}_a$, $\mathbf{32}_b$, $\mathbf{32}_c$, $\mathbf{32}_d$, able to engage with said first and second 341 toothed circular portion, so as to rotate together with said handle 21.

Figure 6:
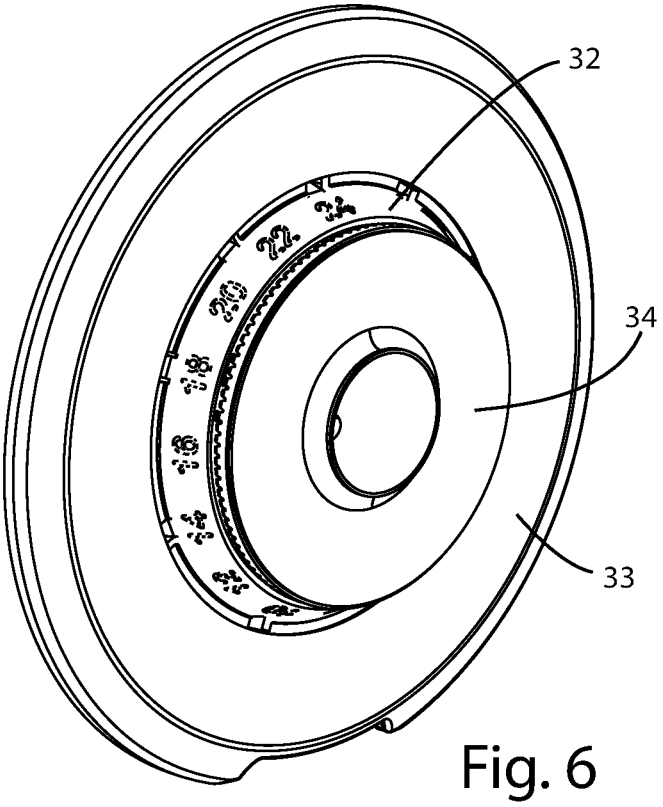
FIG. 6 shows a detail of the system shown in FIG. 1.
Figure 7:
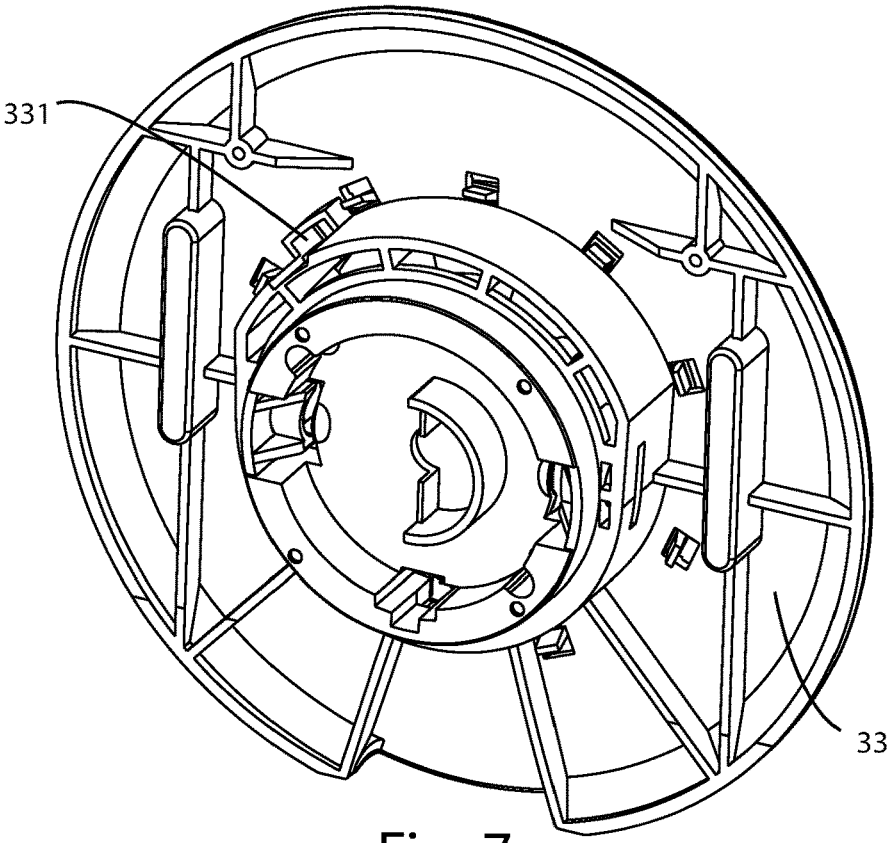
FIG. 7 shows a second view of the detail shown in FIG. 5.
Figure 8:
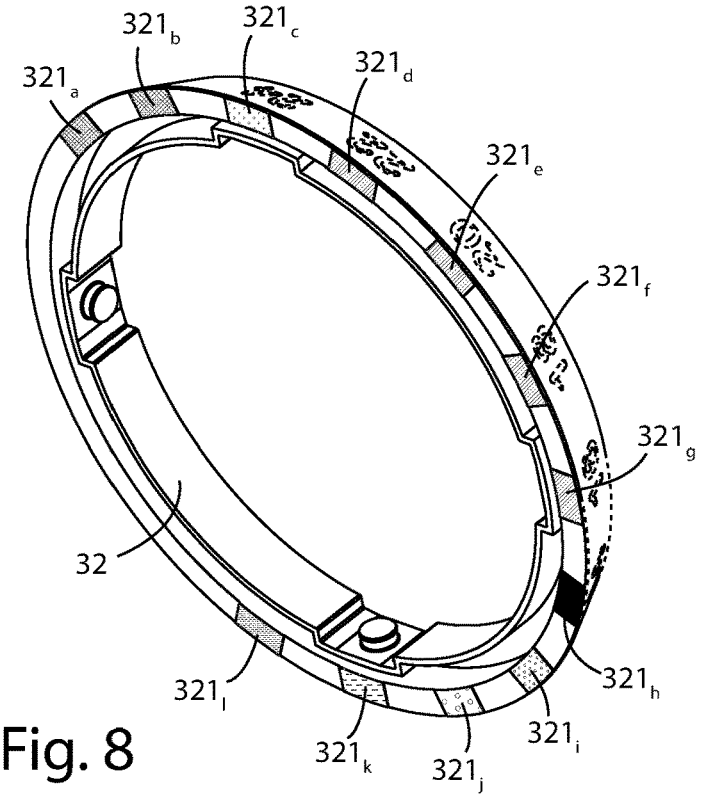
FIG. 8 shows another detail of the system shown in FIG. 1.

Referring in particular to FIGS. 6 and 8, said numbered ring 32 has numbers on its surface corresponding to the value of the weights selected from said first plurality of weights P1.

Said numbered ring 32 also comprises a plurality of reflective portions $\mathbf{321}_{a,\,b,\,\ldots,\,n}$ different from each other and arranged in correspondence with said numbers.

In particular, each reflective portion $\mathbf{321}_k$ is associated to a number of said numbered ring 32.

Said portions of said plurality of reflective portions $321_{a, b, \ldots, n}$ have in particular different reflective characteristics.

Said reflective characteristics determine the respective colors of said portions of said plurality of reflective portions $321_{a, b, \ldots, n}$, therefore, each portion $321_k$ has its own color, different from the color of the other portions.

Said hollow element 31 has on its surface a window $31_a$ which allows to visualise the numbers of the numbered ring 32 while rotating, corresponding to the weight selected by said first plurality of weights P1.

Figure 4:
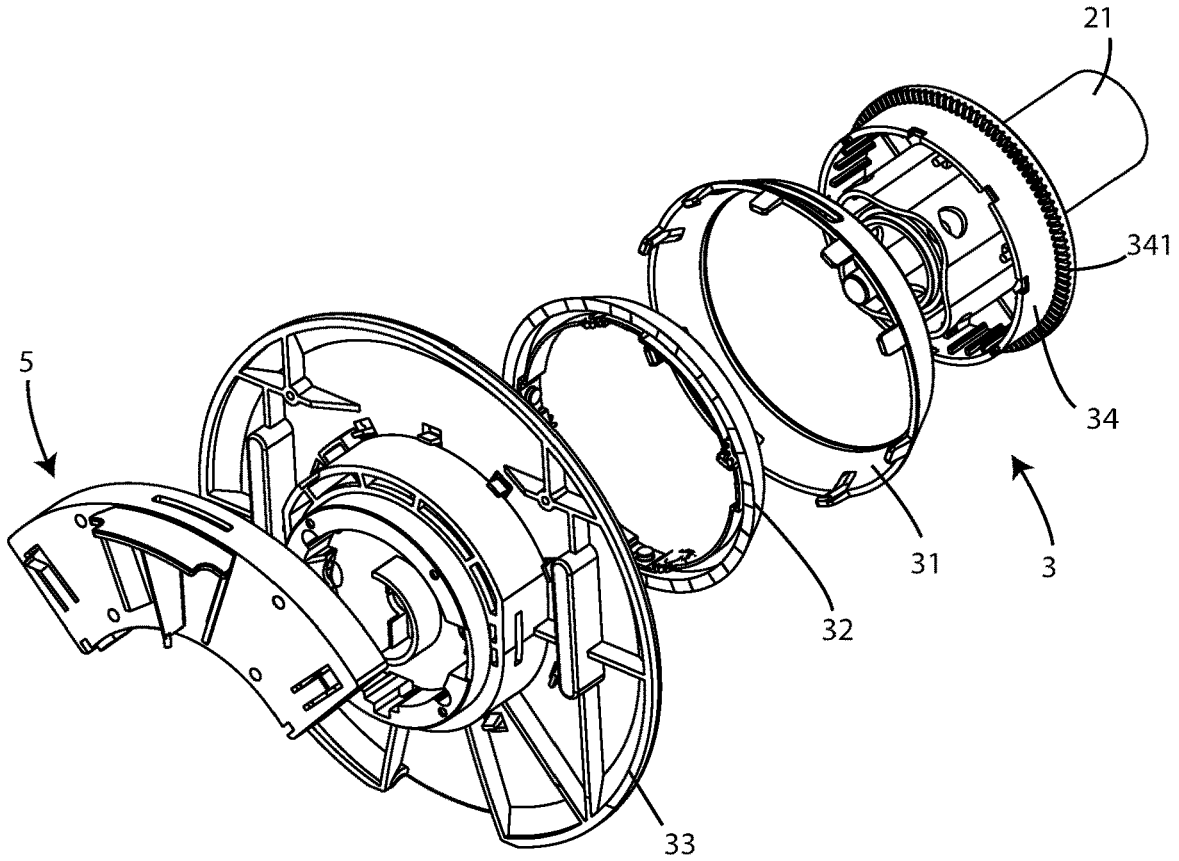
FIG. 4 shows a detail of the exploded view shown in FIG. 2.
Figure 5:
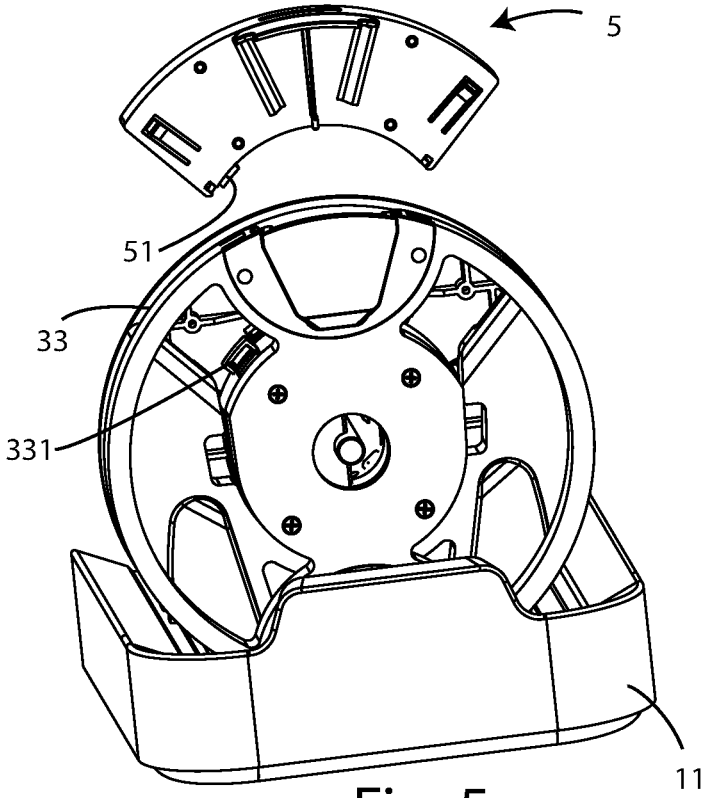
FIG. 5 shows an exploded detail of the system shown in FIG. 1.

Referring to FIGS. 2 and 4, said monitoring system S comprises a device 5 for detecting the selected weight.

In particular, said detection device 5 can be arranged on said first selection member 3, by shape coupling.

Or said detection device 5 can be arranged on said second selection member 4, by shape coupling.

Figure 9:
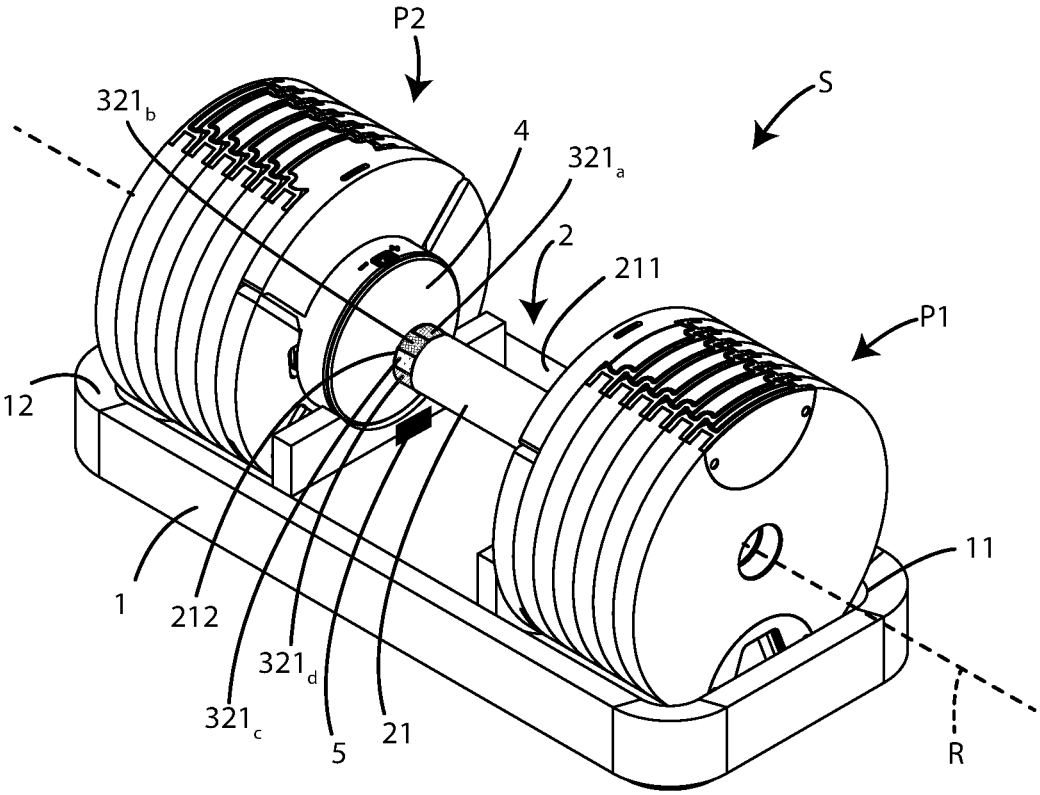
FIG. 9 shows a perspective view of the system for monitoring the weight adjustment of a dumbbell, object of the present invention, in a second embodiment.

Alternatively, referring to FIG. 9, the detection device 5 can be arranged on said support frame 1; in particular, said plurality of reflective portions $321_{a, b, \ldots, n}$ is arranged on said handle 21, and said detection device 5 is arranged below said plurality of reflective portions $321_{a, b, \ldots, n}$.

Figure 10:
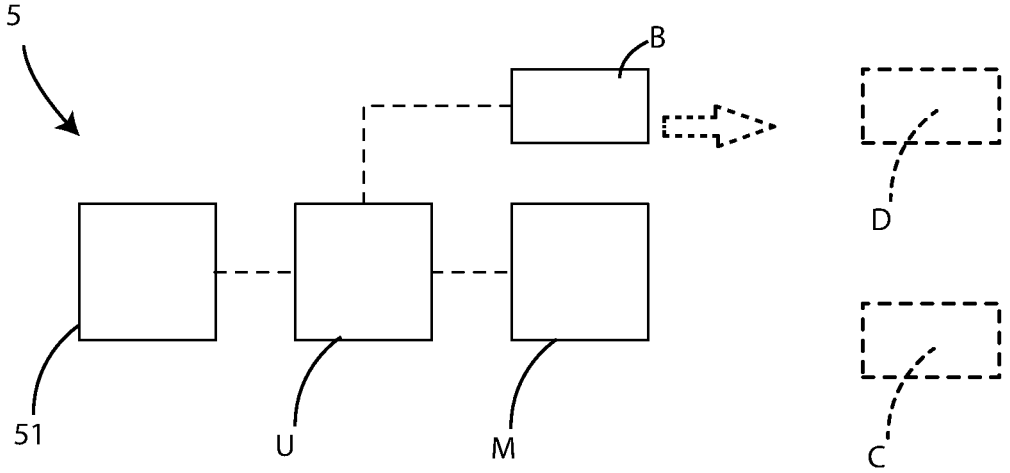
FIG. 10 shows a detail of the system shown in FIG. 1.

Referring now to FIG. 10, said detection device 5 comprises at least one sensor 51, a memory unit M, a logic control unit U and a data communication module B of the wireless type, for example of the Bluetooth® or wi-fi or NFC or Ant+ type.

In said memory unit M there are stored calibration data, associated to the weights that said dumbbell 2 can take.

Said data communication module B is able to send said data received by said logic control unit U to remote devices D, such as a smartphone, or to cloud units C.

Said at least one sensor 51 is able to emit electromagnetic waves having predetermined wavelengths and intensities.

In particular, said at least one sensor 51 is able to emit electromagnetic waves directed towards said plurality of reflective portions $321_{a, b, \ldots, n}$, through said opening 331.

Even more particularly, in the present embodiment, said emitted electromagnetic waves are in the spectrum of visible light (white light).

Said at least one sensor 51 is also able to detect intensity and wavelength of electromagnetic waves incident on it, corresponding to the red color, with a wavelength peak of about 700 nm, to the green color, with a wavelength peak of about 546 nm, and to blue, with a wavelength peak of about 436 nm.

In particular, said at least one sensor 51 is able to detect intensity and wavelength of electromagnetic waves emitted by it and reflected by said plurality of reflective portions $321_{a, b, \ldots, n}$, through said opening 331. More in detail, said at least one sensor 51 comprises an emitter element able to emit electromagnetic waves and a receiver element able to detect the electromagnetic waves reflected by said plurality of reflective portions $321_{a, b, \ldots, n}$, through said opening 331. Said receiver element comprises 3 elements sensitive to the corresponding wavelengths described above.

Each portion $321_k$ of said plurality of reflective portions $321_{a, b, \ldots, n}$ is able to reflect said red, green and blue electromagnetic waves in different proportions, which depend on the respective reflective or absorption characteristics of the light spectrum.

Said at least one sensor 51 is able to convert intensity and wavelength of electromagnetic waves incident on it into one or more data. Such data can be in the form of numerical data representing information such as intensity of the 3 color components, intensity of the total reflected light.

The data thus generated by said at least one sensor 51 are sent to said logic control unit U which processes them.

The logic control unit U is able to compare said data with said calibration data, stored in the memory unit M, in order to select the corresponding associated weight value.

The logic control unit U is also able to send the weight value corresponding to said data to said data communication module B.

Said data communication module B is able to send said weight value to remote devices D and/or to cloud units C.

Alternatively, the logic control unit U is able to send the raw data to said remote devices D and/or to cloud units C which compare said data with the calibration data, so as to identify the value of the corresponding associated weight, on the basis of a dedicated algorithm.

The operation of the system S for monitoring the weight adjustment of a dumbbell object of the present invention takes place as follows.

When a user intends to perform a strength exercise using the dumbbell 2, it is necessary to initially adjust the weight of said dumbbell 2, before lifting it from the support frame 1.

The user can rotate the handle 21 in one direction, for example clockwise, to select one or more weights from said first P1 and second P2 plurality of weights, therefore to increase the weight on the dumbbell 2, or can rotate the handle 21 in the opposite direction, for example counter-clockwise, to uncouple one or more weights from the dumbbell 2, therefore to reduce the weight on the dumbbell 2.

With each rotation of the handle 21, said first 210*a* and second 210*b* selector elements extend to select or retract to release a weight of said first P1 and second P2 plurality of weights.

In particular, said first selector element 210*a* is progressively inserted into the holes of each weight of said first plurality of weights P1, while said second selector element 210*b* is progressively inserted into the holes of each weight of said second plurality of weights P2.

The weights are coupled to each other by shape coupling, so that, by lifting the dumbbell 2 from said support frame 1, the weights selected by said first 210*a* and second 210*b* selector element remain integral with the dumbbell 2, while the unselected weights remain housed on said support frame 1.

In the meantime, both for said first selection member 3 and for said second selection member 4, the rotation of the handle 21 and therefore of the cover 34 causes the rotation of said numbered ring 32, therefore it will be possible to see the value of the weight selected by said window $31_a$.

Furthermore, the rotation of said numbered ring 32 causes the alignment of a specific reflective portion of said plurality of reflective portions $321_{a, b, \ldots, n}$, associated to the weight selected by the user, with said opening 331.

Said at least one sensor 51 emits electromagnetic waves corresponding to the red color, the green color and the blue color, which are reflected by the reflective portion of said plurality of reflective portions $321_{a, b, \ldots, n}$ which is in correspondence with said opening 331.

The intensity and wavelength of the reflected electromagnetic waves are detected by said at least one sensor 51, which then converts them in the form of data.

Said data are transmitted to said logic control unit U.

The logic control unit U compares said data with the calibration data, stored in the memory unit M, and selects the associated weight value corresponding to said data.

The logic control unit U then sends the weight value corresponding to said data communication module B.

Said communication module B also transmits data to remote devices D and/or cloud units C.

As is evident from the above description, the monitoring system object of the present invention allows the detection, in a simple and reliable way, of a weight loaded or released by the dumbbell for performing a gymnastic exercise.

The present invention has been described for illustrative, but not limitative purposes, according to its preferred embodiments, but it is to be understood that variations and/or modifications may be made by those skilled in the art without thereby departing from the relative scope of protection, such as defined by the attached claims.

What is claimed is:

1. A system (S) for monitoring a weight adjustment of a dumbbell, which can be used by a user to perform a gymnastic exercise, the system comprising:

a dumbbell (2) provided with a handle (21) having an axial development along an axis (R), able to rotate around said axis (R), clockwise and counterclockwise, and provided with a first end (211) and a second end (212), a first plurality of weights (P1), wherein each weight can be individually coupled to said first end (211), when said handle (21) rotates in one direction, and decoupled from said first end (211), when said handle (21) rotates in the opposite direction, and a second plurality of weights (P2), wherein each weight can be individually coupled to said second end (212), when said handle (21) rotates in one direction, and decoupled from said second end (212), when said handle (21) rotates in the opposite direction, wherein said system (S) is characterized in that it comprises an element provided with a plurality of reflective portions ($\mathbf{321}_{a,\,b,\,\ldots,\,n}$), in that it comprises at least one detection device (5) able to detect data coming from at least one reflective portion ($\mathbf{321}_k$) and able to send said data, in that it comprises a logic control unit (U) able to receive said data sent by said at least one detection device (5) and to associate with said data a weight of said first (P1) and second (P2) plurality of weights, in that said detection device (5) comprises at least one sensor (51), able to emit electromagnetic waves and receive electromagnetic waves reflected from at least one portion of said plurality of reflective portions ($\mathbf{321}_{a,\,b,\,\ldots,\,n}$), and in that said at least one sensor (51) is arranged in said first end (211) and/or in said second end (212) of said handle (21).

2. The system (S) according to claim 1, characterized in that it comprises a numbered ring (32) comprising a plurality of numbers associated with said first (P1) and second (P2) plurality of weights, and in that said plurality of reflective portions ($\mathbf{321}_{a,\,b,\,\ldots,\,n}$) is arranged on said numbered ring (32), so that each number is arranged in correspondence with a portion of said plurality of reflective portions ($\mathbf{321}_{a,\,b,\,\ldots,\,n}$).

3. The system (S) according to claim 2, characterized in that said at least one sensor (51) is arranged in said first end (211) and/or in said second end (212) of said handle (21).

4. The system (S) according to claim 3, characterized in that said at least one sensor (51) is able to emit electromagnetic waves directed towards said plurality of reflective portions ($\mathbf{321}_{a,\,b,\,\ldots,\,n}$), detect the electromagnetic waves reflected by the at least one portion ($\mathbf{321}_k$) of said plurality of reflective portions ($\mathbf{321}_{a,\,b,\,\ldots,\,n}$) aligned with it, and send corresponding data.

5. The system (S) according to claim 2, characterized in that it comprises a communication module (B) able to receive said data and/or processed data and send them to remote devices (D) or cloud units (C).

6. The system (S) according to claim 1, characterized in that said plurality of reflective portions ($\mathbf{321}_{a,\,b,\,\ldots,\,n}$) are arranged on said handle (21).

7. The system (S) according to claim 1, characterized in that it comprises a support frame (1) to rest said dumbbell (2), and in that said at least one detection device (5) is arranged on said support frame (1).

8. The system (S) according to claim 2, characterized in that said at least one sensor (51) is able to emit electromagnetic waves directed towards said plurality of reflective portions ($\mathbf{321}_{a,\,b,\,\ldots,\,n}$), detect the electromagnetic waves reflected by the at least one portion ($\mathbf{321}_k$) of said plurality of reflective portions ($\mathbf{321}_{a,\,b,\,\ldots,\,n}$) aligned with it, and send corresponding data.

9. The system (S) according to claim 1, characterized in that it comprises a communication module (B) able to receive said data and/or processed data and send them to remote devices (D) or cloud units (C).

10. A method for operating the system (S) for monitoring the weight adjustment of a dumbbell according to claim 1, comprising the following steps:

(a). providing the handle (21) that is able to rotate in one direction to select one or more weights of said first (P1) and second (P2) plurality of weights, or in an opposite direction to release one or more weights from said dumbbell (2);

(b). emitting electromagnetic waves directed towards the at least one portion of said plurality of reflective portions ($\mathbf{321}_{a,\,b,\,\ldots,\,n}$) aligned with said at least one detection device (5);

(c). detecting the electromagnetic waves reflected by the at least one portion ($\mathbf{321}_k$) of said plurality of reflective portions ($\mathbf{321}_{a,\,b,\,\ldots,\,n}$) aligned with it in the form of data;

(d). sending said data to a logic control unit;

(e). processing said data obtained in said step (c) to associate a value of one or more weights selected or released in said step (a); and (f). sending said value in said step (e) to remote devices and/or cloud units.

* * * * *